US005118143A

United States Patent [19]

Gerard

[11] Patent Number: 5,118,143

[45] Date of Patent: Jun. 2, 1992

[54] GEARING FOR AN ESPAGNOLETTE FITTING

[75] Inventor: Prevot Gerard, Willerwald, France

[73] Assignee: Ferco International Usine de Ferrures de Batiment, Sarrebourg, France

[21] Appl. No.: 648,558

[22] Filed: Jan. 31, 1991

[30] Foreign Application Priority Data

Feb. 5, 1990 [DE] Fed. Rep. of Germany ... 9001277[U]

[51] Int. Cl.[5] ..... E05C 9/12

[52] U.S. Cl. ..... 292/39; 292/51

[58] Field of Search ..... 297/39, 336.3, 172, 297/51

[56] References Cited

U.S. PATENT DOCUMENTS

| | | | |
|---|---|---|---|
| 4,002,360 | 1/1977 | Frank et al. | 292/172 |
| 4,616,864 | 10/1986 | Douglas | 292/39 |
| 4,848,811 | 7/1989 | Laufenburg et al. | 292/39 |
| 4,921,285 | 5/1990 | Loos | 292/39 |
| 4,932,691 | 6/1990 | White | 292/336.3 |
| 4,986,582 | 1/1971 | Sting et al. | 292/39 |

FOREIGN PATENT DOCUMENTS

| | | | |
|---|---|---|---|
| 1559735 | 8/1969 | Fed. Rep. of Germany . | |
| 7114555.6 | 4/1971 | Fed. Rep. of Germany . | |
| 2515989 | 10/1976 | Fed. Rep. of Germany | 292/39 |
| 3038508 | 5/1982 | Fed. Rep. of Germany | 292/51 |
| 8515071 | 9/1985 | Fed. Rep. of Germany . | |
| 3742995 | 8/1988 | Fed. Rep. of Germany | 292/39 |
| 3710056 | 10/1988 | Fed. Rep. of Germany . | |
| 8814754.1 | 2/1989 | Fed. Rep. of Germany . | |
| 3738300A1 | 8/1989 | Fed. Rep. of Germany . | |
| 2150972 | 7/1985 | United Kingdom | 292/51 |
| 2156896 | 10/1985 | United Kingdom | 292/39 |

*Primary Examiner*—Eric K. Nicholson
*Attorney, Agent, or Firm*—Chilton, Alix & Van Kirk

[57] ABSTRACT

A positioning rod gearing for use in a window leaf or door leaf, the frame profile (1) of the window or door leaf comprising a receiving groove (3) open in the direction of the folding surface with guide flanges (5) for a positioning rod. The positioning rod gearing comprises a gearing housing (7) which forms an insertable housing part (7*i*) and a guide conduit section (7*c*) and comprises a connecting slide (19) supported in a longitudinally shiftable manner which permanently engages with the drive pinion (13) and carries a cam extension (21) on at least one end, which extension projects out of the guide conduit section (7*c*) and can be coupled to a positioning rod (23). The insertable housing part (7*b*) comprises a support surface (9) for support on the groove bottom (31) of the receiving groove (3) and comprises a receiving bore (27) in support surface (9) for a fastening screw (37) which can be screwed in from the rabbet side into a threaded bore (39) of the groove bottom (31). The invention is particularly useful in an espagnolette fitting for a window or door.

4 Claims, 2 Drawing Sheets

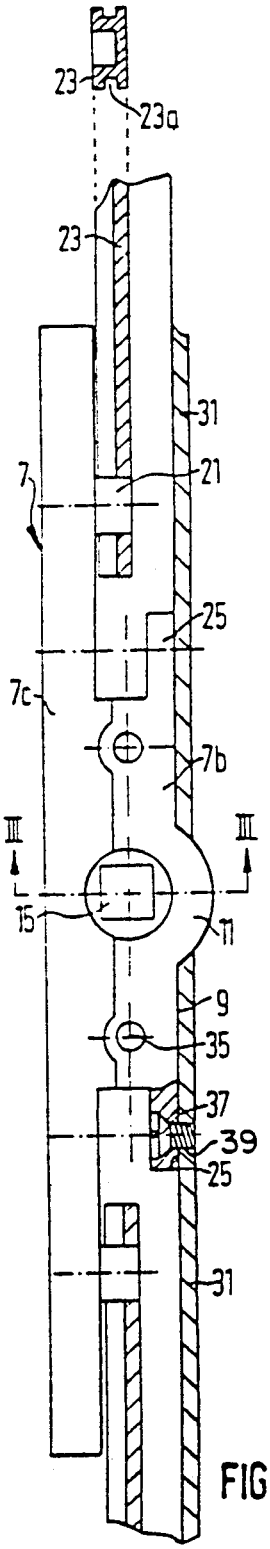
FIG.1
FIG.3
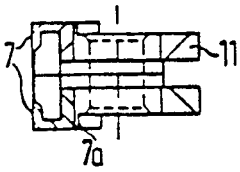
FIG.2
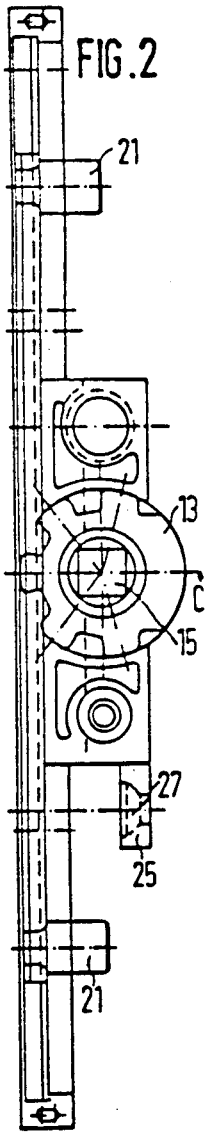
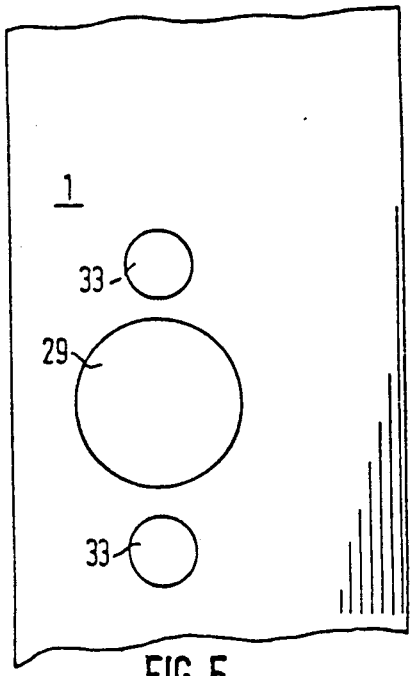
FIG.5
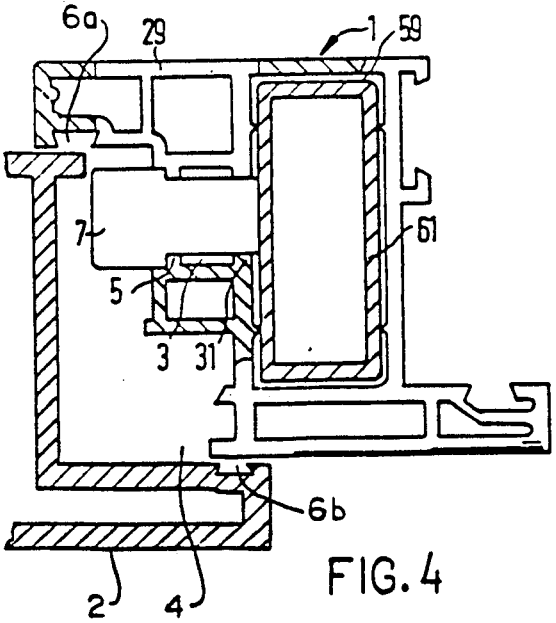
FIG.4

GEARING FOR AN ESPAGNOLETTE FITTING

BACKGROUND OF THE INVENTION

The invention relates to a positioning rod gearing, and more particularly to a positioning rod gearing adaptable for operating door leaves, window leaves, and similar wall closures.

A positioning rod gearing is known from DE-OS 37 10 056. In positioning rod gearings of this type, the positioning rod must be moved with a 90° or 180° rotation of a pinion by a stroke or distance of travel which is sufficient for carrying out the necessary unlocking and locking procedures for the desired opening types, e.g., of a rotating balance or tilting window. In order to obtain a sufficient travel distance of the positioning rod, e.g., 17 or 34 mm, the drive pinion must exhibit a certain minimum radius, which for its part determines the minimum dimension of the gearing housing in the frame plane transversally to the longitudinal direction of the positioning rod. On the other hand, however, the shape of the frame profile dictates the position of the positioning rod in relation to the bearing rosette or round anchor plate, with an operating handle for the pinion of the gearing, which rosette or round anchor plate can be attached to the frame on the room side. The distance between the swivel pin of the operating handle and the plane of the positioning rod, or of the cuff or lock bar on the side of the rabbet space adjacent the leaf profile, is designated as the pin measure. In a fitting of the indicated type, the use of a connecting slide which is offset in relation to the positioning rod in the direction of the rabbet space and which is actuated by the drive pinion achieves the advantage that the radius and therewith the lever arm of the pinion can be greater than the pin measure, so that a sufficiently large travel distance of the positioning rod is achieved in spite of a swivel pin located close to the plane of the positioning rod.

DE-GM 85 15 071 teaches a similar positioning rod gearing; here, however, the pinion does not engage with a connecting slide but rather with a section of the positioning rod itself which is offset or bent out in the direction of the rabbet space.

In the previously known positioning rod gearings, the fastening of the gearing housing to the frame profile takes place exclusively by means of the customary fastening screws of the bearing rosette or anchor plate for the operating handle, which are screwed in on both sides of the actuating pin and parallel to the latter through appropriate bores of the frame profile into threaded contacts of the gearing housing. A certain amount of play transversally to the screw axis, i.e., in the plane of the frame, is unavoidable in the case of such fastening screws arranged vertically to the plane of the leaf frame, so that there is no especially reliable fastening which can also absorb rather strong forces in the longitudinal direction of the positioning rod or vertically to the folding surface. Also, the bearing rosette can not be removed without the gearing housing losing its hold on the leaf frame profile at the same time.

SUMMARY OF THE INVENTION

The invention is directed to the problem of designing a positioning rod gearing that can be fastened to the leaf frame profile in a more reliable and more loadable manner, and for which a cut-out in the bottom wall of the guide groove for receiving projecting parts of the gearing housing is not necessary or can at least be made very small.

The invention comprises a positioning rod gearing for a window leaf or door leaf, the frame profile of the window or door leaf comprising a receiving groove on the movable frame open in the direction of the rabbet space between the movable and stationary frames, with guide flanges for a positioning rod. The positioning rod gearing comprises a gearing housing which forms an insertable housing part and a guide conduit section and comprises a connecting slide supported in a longitudinally shiftable manner which permanently engages with the drive pinion and carries a cam extension on at least one end, which extension projects out of the guide conduit section and can be coupled to a positioning rod. The insertable housing part comprises a support surface for support on the groove bottom of the receiving groove and comprises a receiving bore in the support surface for a fastening screw which can be screwed in from the rabbet side into a threaded bore of the groove bottom.

The invention assures that the support surface resting on the bottom of the guide groove results in unambiguous positioning of the gearing housing transversally to the plane of the positioning rod and that the fastening screws, which can be screwed into threaded bores of the groove bottom, assure a reliable fixing of the gearing housing in the groove independently of an additional fastening by means of fastening screws of a gripping rosette or handle mounting plate, which screws are arranged vertically to the plane of the leaf frame. Depending on the design of the gearing, the drive pinion for the positioning rod, which pinion can be rotated by the operating handle, extends either not at all or only slightly over the support surface, so that no recess or only a relatively small recess for receiving such a projecting part need be provided in the bottom of the guide groove. The invention is particularly useful in an espagnolette fitting for a window or door.

An embodiment of the invention is explained in more detail below with reference made to the drawings.

BRIEF DESCRIPTION OF THE DRAWINGS

FIG. 1 shows a lateral view of the gearing inserted into the profile groove with connected positioning rods.

FIG. 2 shows a lateral view of the gearing with open gearing housing without positioning rods.

FIG. 3 shows a section along line III—III in FIG. 1 through the empty gearing housing without pinion and connecting slide.

FIG. 4 shows a section through the leaf frame profile with the gearing housing fastened to it, and also shows the stationary frame profile.

FIG. 5 shows a lateral view of the room side of the leaf frame profile.

DETAILED DESCRIPTION OF THE INVENTION

Figure 6:
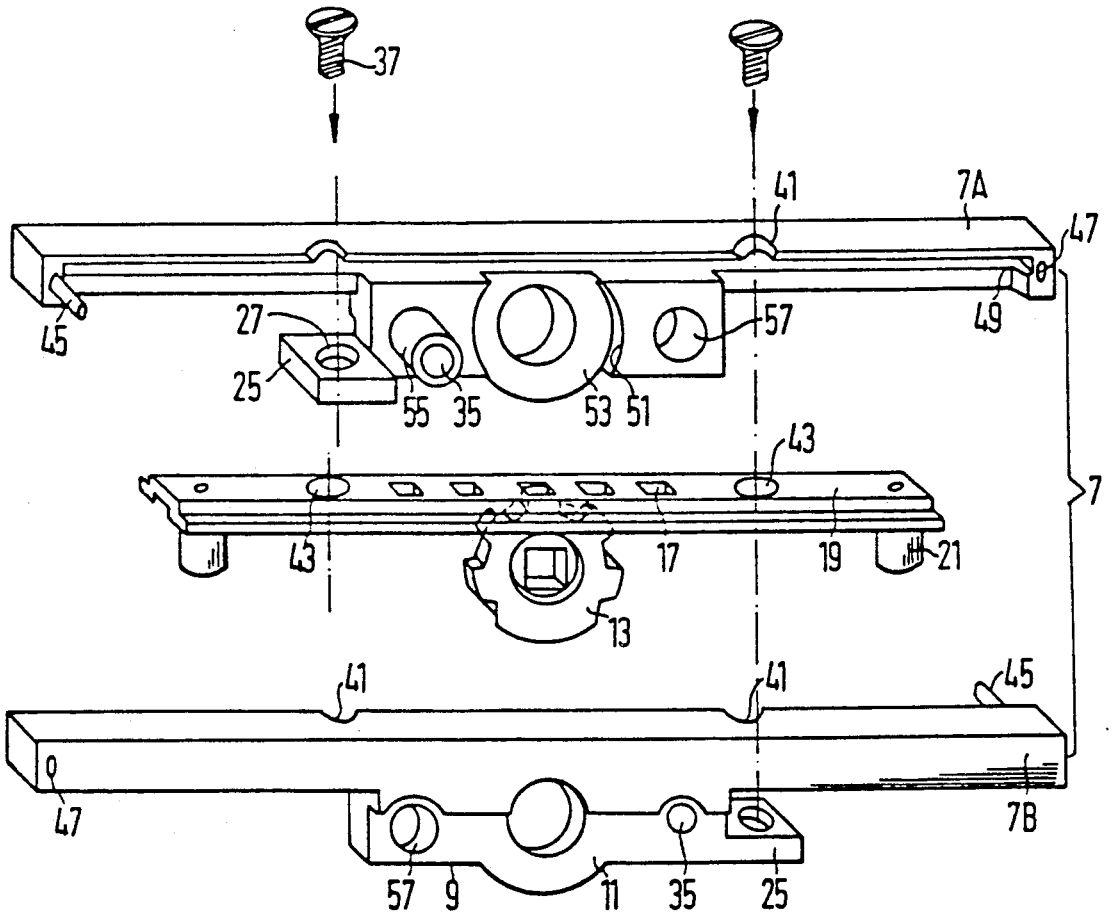
FIG. 6 shows an exploded view of the positioning rod gearing.

According to FIG. 4, the leaf frame profile 1, and the stationary frame profile 2 (simplified illustration), define a rabbet space 4. At least one of the dovetail grooves 6*a* and 6*b* holds a sealing gasket (not shown). The leaf frame profile 1, manufactured from metal or plastic comprises a groove 3 which is open in the direction of the rabbet side and comprises two inwardly projecting guide flanges 5 in the vicinity of the groove opening.

Gearing housing 7, which is shown in FIG. 1 in a lateral view and in FIG. 3 in section, can be partially introduced into groove 3 until lateral shoulders 7*a* of the gearing housing rest on guide flanges 5.

Gearing housing 7 comprises a housing part 7*b*, as can be seen from FIG. 1, which can be introduced into groove 3 and comprises a guide conduit section 7*c* which remains outside of the groove and projects into the rabbet space of the leaf profile. Housing part 7*b* comprises a support surface 9 facing groove bottom (31) of groove 3 on both sides of a segment-like bulge 11. The latter is adapted to the circumference of a pinion 13 supported in housing 7 (FIG. 2), which pinion comprises a square opening 15 for receiving the pin of an operating handle (not shown).

The teeth of pinion 13 engage into hole cogging 17 of connecting slide 19 supported in a longitudinally shiftable manner in guide conduit section 7*c* of gearing housing 7. Connecting slide 19 is considerably longer than housing part 7*b* carrying pinion 13 and carries coupling pins 21 on its ends for engagement into corresponding coupling openings of positioning rods 23, which are guided in a known manner on guide flanges 5 of groove 3 of leaf frame profile 1.

Each positioning rod 23 preferably exhibits the U-shaped profile shown at the top in FIG. 1 with two grooves 23*a* provided in the outer surfaces of the shanks of the U into which grooves guide flanges 5 of guide groove 3 of profile 1 can engage. In this manner, positioning rod 23 is guided at a distance from the bottom of groove 3 and cannot fall away from coupling pins 21.

The connecting slide is designed to be sufficiently long in order that positioning rods 23 can be shifted by the required travel imparted by a 90° or 180° rotation of pinions 13 without striking the front sides of housing part 7*b*. Guide conduit section 7*c* of housing 7 is longer than connecting slide 19 by the amount of the travel distance of connecting slide 19 and thus extends to both sides considerably over housing part 7*b*.

Two support lugs 25 are formed on the two front surfaces of housing part 7*b* as an extension of support surface 9, each lug comprising a receiving opening 27 for a fastening element, especially a slotted flat-head screw. Support lugs 25 are designed to be sufficiently flat that they do not hinder the motion of the end of corresponding positioning rod 23 up to the front wall of housing section 7*b*.

In order to be able to insert gearing housing 7 into groove 3 sufficiently far that support surface 9 rests on the groove bottom, a recess for the segment-like projection 9 and the corresponding circumferential area of the pinion must be created in the groove bottom. This is brought about in that a bore 29 is drilled in from the room side of the leaf frame profile whose diameter is at least as large as the diameter of pinion 13. This bore is positioned so that it runs as a secant to profile flange 31 of leaf profile 1, which flange 31 forms the bottom of groove 3, as a result of which the recess adapted to segment projections 9 is created in the latter. At the same time, two smaller bores 33 for receiving fastening screws of the gripping rosette or handle mounting plate (not shown) of the operating handle are drilled in from the room side. The associated fastening screws engage in corresponding threaded bores 35 of gearing housing 7 inserted into groove 3 so that the gripping rosette or handle mounting plate and the gearing housing are fixed to profile 1 at the same time. This was the sole fastening of the gearing to the leaf profile in the previously known gearings of this type.

However, an additional fastening to bottom 31 of groove 3 takes place in gearing housing 7 in accordance with the invention by means of two slotted flat-head screws which are screwed in through corresponding bores 27 of support lugs 25 into previously positioned threaded bores 39 of groove bottom 31. In order to be able to screw in these screws 37, corresponding openings 41,43 are provided in alignment with bores 27 in guide conduit section 7*c* and in connecting slide 19 (cf. FIG. 6) through which openings screws 37 and the appropriate screwdriver can be run when the connecting slide is located in a preset position, e.g., the middle position. The screwing to groove bottom 31 achieves a very reliable positive fixing of the gearing housing to frame profile 1 independently of the fastening of the gripping rosette or handle mounting plate.

Gearing housing 7 is composed of two housing halves 7A, 7B in an especially preferred embodiment shown in FIG. 6. The two housing halves 7A, 7B are identical and are uniform with each other when turned around. A pin 45 is formed on one end of each housing half 7A, 7B which engages into a corresponding pin opening 47 in the other housing half in order to connect the two housing halves to one another. A through guide groove 49 running in the longitudinal direction is constructed in each housing half which together form the guide conduit (cf. FIG. 6) for the connecting slide. Each housing half 7A, 7B also comprises one of the support lugs 25, which extends over the entire width of both housing halves. Furthermore, each housing half forms a bearing trough 53 limited by circular cheeks 51 in which pinion 13 is supported. In addition, each housing half comprises a projecting hollow pin 55 which is received by a corresponding circular opening 57 in the other housing half. A threaded bore 35 for the fastening screws of the rosette is formed in the inside of each hollow pin 55.

As FIG. 6 shows, connecting slide 19 exhibits an approximately hat-shaped cross section, so that its central area, in which the hole cogging is located, is offset slightly further from the axis of the pinion in relation to the edge areas. This also contributes to the housing of a pinion with as large an effective radius as possible at a given height dimension of the gearing housing.

Bulge 11 of gearing housing 7, which bulge is adapted to pinion 13, extends preferably only a few mm, e.g., 5 mm, over support surface 9. As FIG. 4 shows, bulge 11 therefore extends only slightly inward over groove bottom flange 31 into hollow chamber 59 of profile 1. It is therefore possible to insert, e.g., a metal reinforcement rod 61 in hollow chamber 59 of profile 1 without this being hindered by gearing housing 7. This renders the positioning rod gearing of the invention particularly advantageous for mounting in PVC window profiles.

The invention is not limited to the details of the embodiment shown. In particular, the invention can also be used with full advantage when the gearing housing comprises a continuous support surface 9 without bulge 11 for the pinion. In this instance, there is no need to position a recess in groove bottom 31, and the fastening of gearing housing 7 to groove bottom 31 by means of screws 37 is particularly advantageous for exact positioning of gearing housing 7. Various other modifications and equivalent arrangements are contemplated, and are included within the scope of the claims.

What is claimed is:

1. A gearing for an espagnolette fitting for locking a movable frame to a stationary frame of a wall closure, the movable frame and stationary frame having respective rabbet sides which define a rabbet space, the espagnolette fitting having at least one positioning rod (23) operatively connected to the gearing, the positioning rod being guided in a groove (3) formed on the rabbet side of the movable frame, the groove (3) having first and second sides and a bottom (31), and having first and second guide shoulders (5) for supporting the gearing, the guide shoulders projecting inward on the first and second sides of the groove (3) proximate the rabbet side of the movable frame, the groove bottom (31) having a threaded bore (39), the gearing comprising:

a gearing housing (7) which forms a housing part (7*b*) which can be inserted in the groove (3) and forms a guide conduit section (7*c*) located outside of the groove, the housing part (7*b*) including a support surface (9) for support on the groove bottom (31) of the groove (3) and having at least one receiving bore (27) in the support surface (9) for a fastening screw (37) which can be inserted from the rabbet space into the threaded bore (39) of the groove bottom (31), a drive pinion (13) supported in the gearing housing (7) and rotatable by means of an operating handle, the drive pinion having a first side facing the groove and a second side facing away from the groove, and a connecting slide (19) supported in a longitudinally shiftable manner in the guide conduit section (7*c*) of the housing, which connecting slide permanently engages with the drive pinion (13) on the second side of the drive pinion and carries a cam extension (21) on at least a first end, which cam extension (21) projects out of the guide conduit section (7*c*) and can be coupled to the positioning rod (23).

2. A gearing according to claim 1, wherein the support surface (9) is located on both sides of a segment-like projection (11) of the gearing housing (7), which projection corresponds to the contour of the pinion (13) and can be introduced into a perforation of the groove bottom (31).

3. A gearing according to claim 1, wherein each receiving bore (27) is provided in a support lug (25) projecting in the longitudinal direction of the housing from the housing part (7*c*) and a free space for the shifting motion of the positioning rod (23) is provided between the support lug (25) and the guide conduit section (7*c*).

4. A gearing according to claim 3, wherein the receiving bore (27) of each support lug (25) is opposed by a lead-in opening (41) of the guide conduit section (7*c*) and by a lead-in opening (43) of the connecting slide (19).

* * * * *